US006733807B2

(12) United States Patent
Martuch et al.

(10) Patent No.: US 6,733,807 B2
(45) **Date of Patent: *May 11, 2004**

(54) EASILY EXPANDABLE, NONTRAPPING, FLEXIBLE PAPER, MICROWAVE PACKAGE

(75) Inventors: Thomas J. Martuch, Eden Prairie, MN (US); Randal J. Monforton, Eden Prairie, MN (US); Marsha D. Thompson Hunt, Minneapolis, MN (US); Melissa L. Jacobs, Fort Wayne, IN (US)

(73) Assignee: General Mills, Inc., Minneapolis, MN (US)

( * ) Notice: Subject to any disclaimer, the term of this patent is extended or adjusted under 35 U.S.C. 154(b) by 209 days.

This patent is subject to a terminal disclaimer.

(21) Appl. No.: 10/050,695

(22) Filed: Jan. 15, 2002

(65) Prior Publication Data

US 2002/0106427 A1 Aug. 8, 2002

Related U.S. Application Data

(63) Continuation-in-part of application No. PCT/US00/17111, filed on Jun. 20, 2000, which is a continuation of application No. 09/354,545, filed on Jul. 15, 1999, now Pat. No. 6,306,448, said application No. PCT/US00/17111, is a continuation of application No. 09/943,637, filed on Aug. 31, 2001, now Pat. No. 6,660,983.

(51) Int. Cl.[7] ..... B65D 30/10

(52) U.S. Cl. ..... 426/107; 426/111; 426/115; 426/122; 426/123; 426/234; 426/243; 219/727; 219/730

(58) Field of Search ..... 426/107, 111, 426/115, 122, 123, 234, 243; 219/727, 730

(56) References Cited

U.S. PATENT DOCUMENTS

| | | | |
|---|---|---|---|
| 2,673,805 A | 3/1954 | Colman | 426/111 |
| 3,052,554 A | 9/1962 | Colman | |

(List continued on next page.)

FOREIGN PATENT DOCUMENTS

| | | |
|---|---|---|
| EP | 0205304 | 12/1986 |
| EP | 0294087 | 12/1988 |

(List continued on next page.)

*Primary Examiner*—N. Bhat
(74) *Attorney, Agent, or Firm*—John A. O'Toole; Alan D. Kamrath; Douglas J. Taylor

(57) ABSTRACT

A flexible paper microwave package in the form of an easily expandable, nontrapping bag (18) is disclosed including a bottom wall (20) and a top wall (22) interconnected together adjacent their circular outer peripheries (20*a,* 22*a*) by first and second interconnection portions (26*a,* 26*b*). In one preferred form, the top wall (22) is formed from a first portion (22*d*) having an oval shaped access opening closed by an oval shaped closure portion (22*e*) interconnected by a seal (40) to the first portion (22*d*). The bottom and top walls (20, 22) expand into an opposing double domed shape as the food product is being popped, puffed, or expanded in the microwave oven. This domed shape of the bottom wall (22) keeps the food product huddled closer together and enhances the bag (18) to rock to maximize gravimetric separation. The bag (18) provides a serving bowl function when the peelable closure seal (40) has been opened providing access to the interior of the bag (18) and specifically to the popped, puffed or expanded food product located therein. An extension (42) integrally extends from the closure portion (22*e*) along the major axis of the oval shape. First and second pairs of extensions (54) integrally extend from diametric opposite sides of the bottom and top walls (20,22) and along the major axis of the oval shape. Slits (60,66,74) relieve the constraints of the extensions (54) to creasing and puckering of the bottom and top walls (20,22) as they expand into the opposing double dome shape.

35 Claims, 4 Drawing Sheets

U.S. PATENT DOCUMENTS

| | | | | |
|---|---|---|---|---|
| 3,235,165 | A | | 2/1966 | Jackson ..... 229/123.1 |
| 3,389,783 | A | | 6/1968 | Bjorkengren ..... 206/46 |
| 3,835,280 | A | | 9/1974 | Gades et al. ..... 219/729 |
| 3,873,735 | A | | 3/1975 | Chalin et al. ..... 426/87 |
| 3,973,045 | A | | 8/1976 | Brandberg et al. |
| 4,141,487 | A | | 2/1979 | Faust et al. ..... 426/111 |
| 4,292,332 | A | | 9/1981 | McHam ..... 426/111 |
| 4,358,466 | A | | 11/1982 | Stevenson ..... 426/106 |
| 4,448,309 | A | | 5/1984 | Roccaforte et al. |
| 4,450,180 | A | | 5/1984 | Watkins ..... 426/107 |
| 4,453,665 | A | | 6/1984 | Roccaforte et al. |
| 4,491,224 | A | | 1/1985 | Horvath ..... 206/484 |
| 4,548,826 | A | | 10/1985 | Watkins ..... 426/394 |
| 4,571,337 | A | | 2/1986 | Cage et al. ..... 426/107 |
| 4,596,713 | A | | 6/1986 | Burdette ..... 426/107 |
| 4,640,838 | A | | 2/1987 | Isakson et al. ..... 426/107 |
| 4,673,601 | A | | 6/1987 | Lamping et al. ..... 428/35 |
| 4,708,249 | A | | 11/1987 | Emslander et al. ..... 206/630 |
| 4,734,288 | A | | 3/1988 | Engstrom et al. ..... 426/107 |
| 4,810,844 | A | | 3/1989 | Anderson ..... 426/107 X |
| 4,851,246 | A | | 7/1989 | Maxwell et al. ..... 426/107 |
| 4,874,620 | A | | 10/1989 | Mendenhall et al. ... 426/107 X |
| 4,892,744 | A | | 1/1990 | Ylvisaker ..... 426/111 |
| 4,911,938 | A | | 3/1990 | Fisher et al. ..... 426/107 |
| 4,925,684 | A | | 5/1990 | Simon ..... 426/107 |
| 4,936,464 | A | | 6/1990 | Kim ..... 206/617 |
| 4,942,050 | A | | 7/1990 | Ylvisaker ..... 426/394 |
| 4,950,859 | A | | 8/1990 | Anderson ..... 426/111 X |
| 4,963,374 | A | | 10/1990 | Brandel et al. ..... 426/107 |
| 4,973,810 | A | | 11/1990 | Brauner ..... 426/107 X |
| 5,039,001 | A | | 8/1991 | Kinigakis et al. ..... 426/118 |
| 5,120,553 | A | | 6/1992 | Kupcikevicius ..... 426/129 |
| 5,171,950 | A | | 12/1992 | Brauner et al. ..... 426/107 X |
| 5,189,272 | A | | 2/1993 | McDonald et al. ..... 426/107 X |
| 5,195,829 | A | | 3/1993 | Watkins et al. ..... 383/100 |
| 5,294,764 | A | | 3/1994 | Mass ..... 426/107 X |
| 5,302,790 | A | | 4/1994 | Turpin ..... 219/727 |
| 5,460,839 | A | | 10/1995 | Archibald ..... 426/107 |
| 5,473,142 | A | | 12/1995 | Mass ..... 219/727 |
| 5,498,080 | A | | 3/1996 | Dalea et al. ..... 383/120 |
| 5,576,037 | A | | 11/1996 | Moore, Jr. et al. ..... 426/110 |
| 5,622,432 | A | | 4/1997 | Zicker ..... 383/210 |
| D393,590 | S | | 4/1998 | Roney ..... D9/305 |
| 5,770,839 | A | | 6/1998 | Ruebush et al. ..... 219/727 |
| 5,786,010 | A | | 7/1998 | Yannuzzi ..... 426/107 |
| 5,958,482 | A | * | 9/1999 | Monforton ..... 426/107 |
| 5,989,608 | A | | 11/1999 | Mizuno ..... 426/113 |
| 6,030,652 | A | | 2/2000 | Hanus ..... 426/107 |
| 6,060,095 | A | | 5/2000 | Scrimager ..... 426/107 |
| 6,060,096 | A | | 5/2000 | Hanson et al. ..... 426/107 |
| 6,066,346 | A | | 5/2000 | Hunt et al. ..... 426/107 |
| 6,077,551 | A | * | 6/2000 | Scrimager ..... 426/107 |
| 6,231,903 | B1 | | 5/2001 | Ji et al. ..... 219/730 |
| 6,259,079 | B1 | * | 7/2001 | Ji et al. ..... 219/727 |
| 6,306,448 | B1 | * | 10/2001 | Martuch et al. ..... 426/107 |
| 6,410,065 | B1 | * | 6/2002 | Nottingham et al. ..... 426/87 |
| 6,660,983 | B2 | | 12/2003 | Monforton et al. ..... 219/727 |

FOREIGN PATENT DOCUMENTS

| | | |
|---|---|---|
| GB | 776382 | 6/1957 |
| GB | 2096576 | 10/1982 |
| JP | 3275474 | 6/1991 |
| JP | 418273 | 1/1992 |
| JP | 10230978 | 9/1998 |
| WO | WO 9109656 | 7/1991 |
| WO | WO 9319566 | 9/1993 |
| WO | WO 9920542 | 4/1999 |
| WO | WO 9952790 | 10/1999 |
| WO | WO 0105678 | 1/2001 |

* cited by examiner

EASILY EXPANDABLE, NONTRAPPING, FLEXIBLE PAPER, MICROWAVE PACKAGE

CROSS REFERENCE

The present application is a continuation-in-part of International Appln. No. PCT/US00/17111 filed Jun. 20, 2000 which is a continuation of U.S. application Ser. No. 09/354,545 filed Jul. 15, 1999, now U.S. Pat. No. 6,306,448 and a continuation of U.S. application Ser. No. 09/943,637 filed Aug. 31, 2001, now U.S. Pat. No. 6,660,983.

BACKGROUND OF THE INVENTION

The present invention relates generally to packages for use in microwave ovens, pertains particularly to an easily expandable, nontrapping, flexible, microwave package formed of non-extendable material for the popping, puffing or expanding of food products and especially popcorn kernels, and pertains more particularly to a microwave package providing serving bowl and/or easy open features.

To conserve space during shipping and storage, microwave popcorn packages are often folded flat. During popping by use of microwave energy, the popcorn package expands, with the expansion due to the internal pressure of the steam produced by the popping of the popcorn kernels and evaporation of the water content of the flavoring slurry, the pressure of the popped kernels themselves, as well as other factors. An important feature for maximizing the volume of the popped kernels is the ability of the microwave popcorn package to easily expand. Another important factor for maximizing the volume of the popped kernels is that the number of kernels which are actually popped be maximized by insuring that the unpopped kernels are located together on the susceptor with sufficient dwell time to receive sufficient heat energy to result in popping. The shape of the bag plays an important role in the ability of the bag to expand as well as the ability of unpopped kernels to come in contact with each other and the susceptor before and during popping.

One form of conventional popcorn packages is a bag having a rectangular top, a rectangular bottom and pleated sides and with at least one end being sealed together by attaching the top and bottom together such as but not limited to by folding the end of the bag over onto itself. It is a common problem for unpopped kernels to be propelled in the popping process into folds and crevices in the bag and especially those created by the pleats in the sides adjacent to the end(s) of the bag. Such kernels may tend to be captured in such folds and crevices so that they are unable to travel towards the susceptor and are less likely to be popped during microwave cooking.

Further, conventional rectangular popcorn bags tend to get hung up in the corners of the microwave ovens. This is undesirable for microwave ovens including turntables as the bag will no longer rotate inside of the microwave cavity but is locked in position by the corner. However, even for microwave ovens which are not equipped with turntables, the expansion of the bag and/or the vibration of the bag caused by the popping of the popcorn kernels do not result in moving the bag to the center of the microwave cavity when the bag gets hung up in a corner of the microwave cavity. This is undesirable as cooler spots typically exist in the corners of the microwave cavity and as lack of movement of the bag subjects certain points in the bag to see specific hot spots or electronic nulls.

Thus, a need continues to exist for an improved flexible paper popcorn package which is easily expandable by the dynamics involved in popping the kernels, which is less likely to capture unpopped kernels during the expansion of the package while subjected to microwave energy, and which provides the most consistent and uniform distribution of microwave energy in maximizing the number and volume of popped popcorn. In further aspects of the present invention, the popcorn package which is utilized to pop the popcorn kernels has the ability to be utilized as the serving bowl during consumption of the popped kernels. In still other aspects of the present invention, the expanded popcorn package can be easily opened by the consumer with minimal instructions.

Surprisingly, the above need and other objectives can be satisfied by providing, in the preferred form, an expandable microwave package in the form of a bag formed by top and bottom walls of flexible, non-extendable material interconnected together adjacent to their round-like shaped outer peripheries so that the top and bottom walls expand into an opposing double domed shape when the food products are popped, puffed or expanded in the microwave oven.

In a most preferred form, the top wall is fabricated from multiple layers and includes a first annular portion having an access opening and a closure portion of a size greater than the access opening and interconnected to the first portion by a seal, with the access opening, closure portion, and seal being oval in shape. In most preferred aspects, the seal is of the cold seal type formed of natural rubber and isoprene and/or synthetic copolymers and which fails during microwave cooking, allowing trapped steam to vent and allowing the removal of the closure portion to provide access to the popped, puffed or expanded food product. Also, in most preferred aspects, an extension is formed on the outer periphery of the closure portion and extending in line with the major axis of the oval shape for grasping when removing the closure portion.

In other preferred aspects of the present invention, the bag formed by the interconnection of top and bottom walls having round-like shaped outer peripheries is folded about first and second, parallel, fold lines located on opposite sides of the oval shaped closure panel so the seal between the annular and closure portions are not subjected to a hard fold. The bag is then folded about a third fold line extending perpendicularly between the first and second fold lines at which time the food products are introduced through the periphery interconnection portion which is then sealed, and then folded about a fourth fold line extending parallel to the third fold line, with the folded bag having a conventional, rectangular shape for secondary packaging.

In still other preferred aspects, extensions are formed on the outer peripheries of the top and bottom walls outward of the interconnection, with the consumer grasping the extensions for removing the bag from the microwave oven, for carrying the bag, and for opening the bag. In preferred aspects, the extensions of the top and bottom walls are in line with the extension of the closure panel of a multiple layer top wall for ease of removal of the closure panel. For other preferred aspects, the extensions extend on diametrically opposite sides of the bag for providing optimal gripping by two hands when the bag is utilized as a serving bowl.

In preferred forms of the present invention, slits are formed in the extensions for relieving constraints to the puckering of the walls of the bag as the bag expands when the food product pops, puffs or expands. In preferred aspects of the present invention, the slits can be expanded to define an opening, can be spaced inwardly from or can intersect the extension outer edge, and/or can include scrolled ends.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
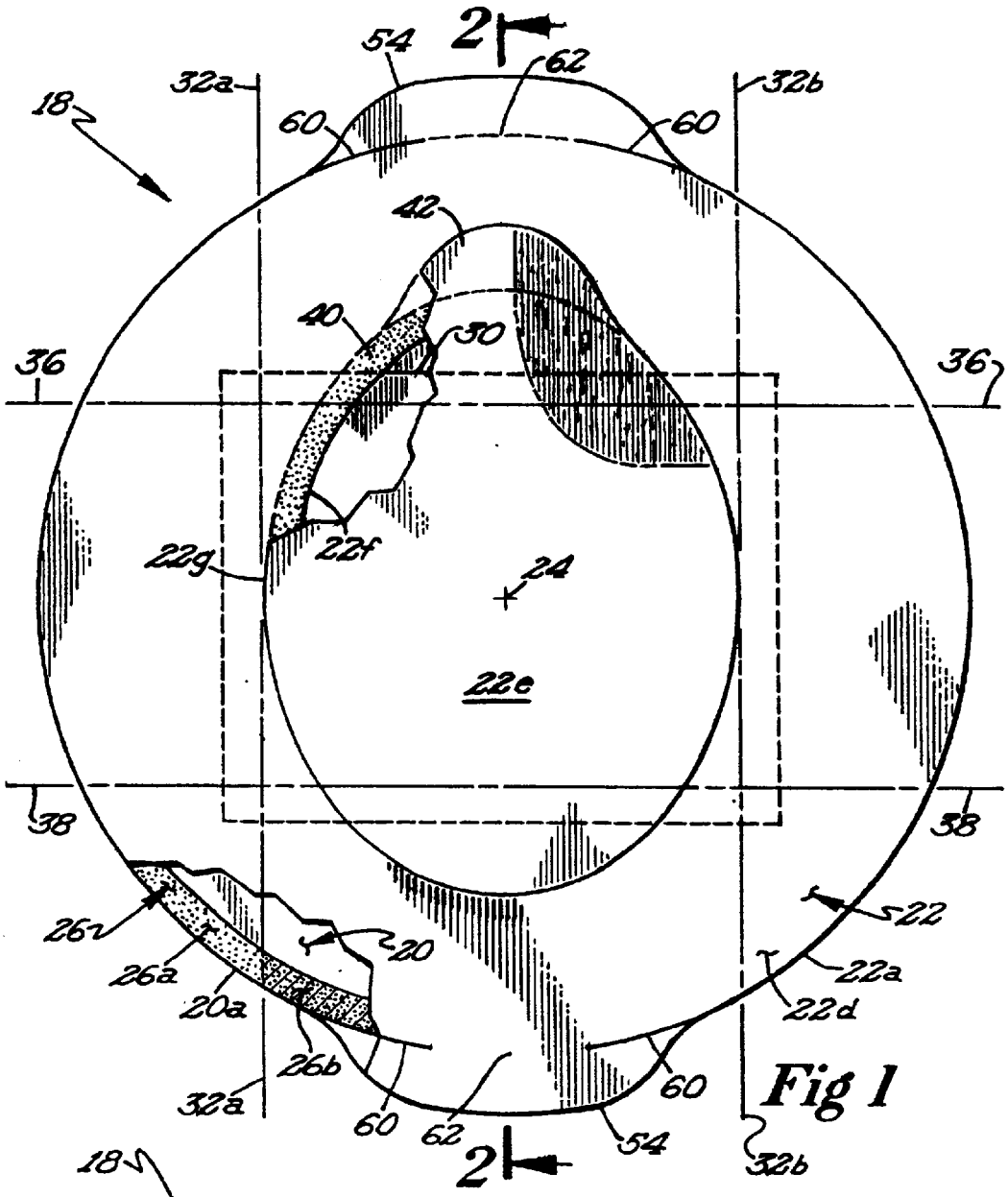
FIG. 1 shows a top plan view of a package fabricated in accordance with the preferred teachings of the present invention in an unfilled, flat condition, with portions broken away.

All figures are drawn for ease of explanation of the basic teachings of the present invention only; the extensions of the Figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "side", "end", "inner", "outer", "inside", "outside", and similar terms are used herein, it should be understood that these terms have reference only to the structure shown in the drawings as it would appear to a person viewing the drawings and are utilized only to facilitate describing the preferred embodiments.

DESCRIPTIONS OF THE PREFERRED EMBODIMENTS

A package for use in microwave ovens according to the preferred teachings of the present invention is shown as an expandable, flexible bag in the drawings and generally designated 18. In the most preferred embodiments of the present invention, bag 18 is an improvement of the type shown in U.S. Pat. Nos. 5,958,482 and 6,066,346 and in International Publication WO 99/20542. For purpose of explanation of the basic teachings of the present invention, the same numerals designate the same or similar parts. The description of the common numerals and bag 18 may be found herein and in U.S. Pat. Nos. 5,958,482 and 6,066,346 and in International Publication WO 99/20542, which are hereby incorporated herein by reference.

It will facilitate the ensuing description to consider bag 18 in the horizontal position when placed in the microwave oven. Therefore, bag 18 includes a bottom wall 20 and a top wall 22 of a shape and size generally corresponding to bottom wall 20. Each wall 20 and 22 is formed by a sheet of flexible but non-extendable material such as papers including but not limited to base coated paper or similar cellulose structures, polymers including but not limited to polyethylene terephthalate, polyester and nylon, or other like microwaveable materials. The material forming walls 20 and 22 can be opaque, translucent, clear, or combinations thereof Each wall 20 and 22 includes an outer periphery 20*a* and 22*a*, respectively, which is generally equidistant from the center 24 of the shape of walls 20 and 22 and in the most preferred form is generally circular in shape. However, peripheries 20*a* and 22*a* could be in other substantially round or round-like shapes which are arcuate and/or include peripheral edge interconnections which do not have a tendency of getting hung up in the corners of the microwave oven such as symmetrical shapes including ovals, pentagons, hexagons, heptagons, octagons, etc. and such as non-symmetrical shapes such as a generally egg shape.

To define a hollow interior, walls 20 and 22 are interconnected together adjacent to peripheries 20*a* and 22*a* by a seal which maintains the integrity of bag 18 during manufacture, handling, transportation and retailing of bag 18 and its contents and until microwave cooking. In the most preferred form, the interconnection between walls 20 and 22 is sufficient so as to seal adequately the vapor created within the bag 18 during the heating thereof in the microwave oven as well as to prevent undesired opening during the consumption of the popped, puffed, or expanded food products. In the most preferred form, a suitable annular adhesive strip 26 is added to the inside surface of one or both of walls 20 and 22 to secure walls 20 and 22 together adjacent peripheries 20*a* and 22*a* after the application of heat and/or pressure. Additionally, when interconnected by adhesive strip 26, walls 20 and 22 can be positioned so that they are generally planar and continuously abut without bulges or folds in the most preferred form.

Bag 18, according to the preferred teachings of the present invention, can be manufactured in the following manner. Specifically, walls 20 and 22 are positioned with their inside surfaces abutting together and with peripheries 20*a* and 22*a* aligned. A first, interconnection portion 26*a* of strip 26 is suitably activated to interconnect walls 20 and 22 together aside from a second, interconnection portion 26*b*. While first, interconnection portion 26*a* extends a substantial portion of peripheries 20*a* and 22*a*, second, interconnection portion 26*b* in the preferred form has a radial extent generally equal to one half of the diameter of the shape of peripheries 20*a* and 22*a*.

Figure 2:
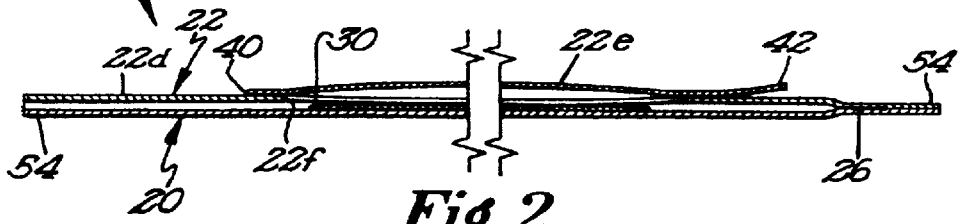
FIG. 2 shows a cross sectional view of the package of FIG. 1 according to section line 2—2 of FIG. 1.
Figure 4:
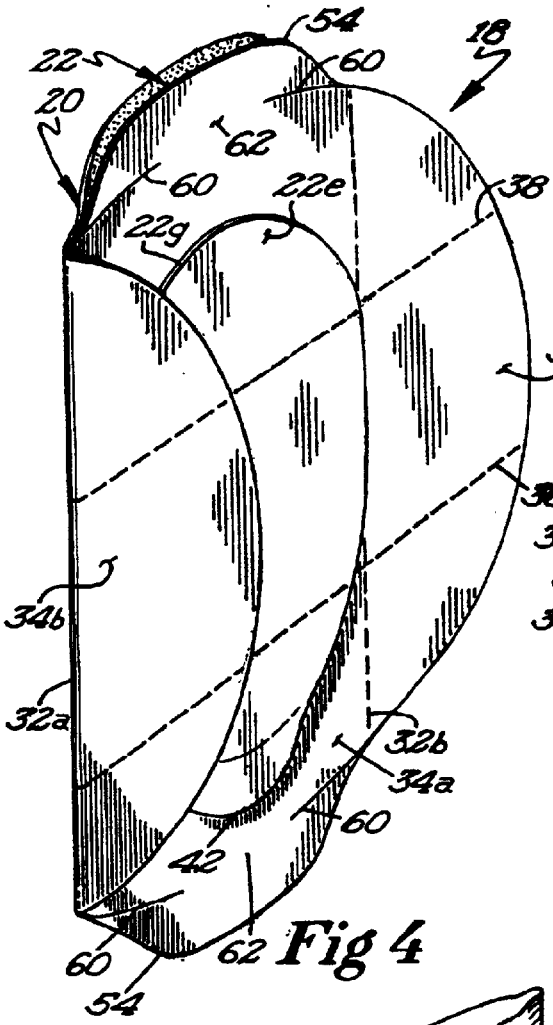
FIG. 4 shows a perspective view of the package of FIG. 1 in an unfilled, partially folded condition, with portions broken away.

In the most preferred form, bag 18 includes a susceptor patch 30 that extends over a portion of bottom wall 20 spaced from periphery 20*a* and in the most preferred form generally centered about center 24. Susceptor patch 30 can be formed in any suitable manner known in the art such as a metalized plastic film adhered to bottom wall 20 as diagrammatically shown in FIG. 2 (with the thickness of susceptor patch 30 being exaggerated for ease of illustration) or adhered between separate layers forming bottom wall 20, as a paper backed susceptor, or as a coating applied or printed to bottom wall 20. Further, although susceptor patch 30 is shown as overlying bottom wall 20 and thus located inside of bag 18, susceptor patch 30 can be located outside of bag 18 with bottom wall 20 overlying susceptor patch 30. Further, placement of susceptor patch 30 can occur at the material converter or on the manufacturing lines.

In the preferred form shown, top wall 22 is fabricated from multiple layers of material. In a preferred form as shown, top wall 22 is formed from first and second wall portions 22*d* and 22*e* which are interconnected by a seal 40. In the preferred form shown, portion 22*d* is generally annular in shape including outer periphery 22*a* and an inner periphery 22*f* defining an access opening which is oval in the most preferred form, with periphery 22*a* being of a size larger than periphery 22*f* The size of the access opening should be sufficient to extend a hand into the interior of bag 18 and grasp popped, puffed or expanded food product therefrom. Portion 22*e* is generally oval in shape and includes an outer periphery 22*g* which is of a shape generally corresponding to periphery 22*f* but of a size slightly greater than periphery 22*f*. In the most preferred form, outer periphery 22*g* includes an extension 42 beyond the otherwise oval shape and in the direction of and in line with the major axis of the oval shape, with extension 42 being of a size located within outer periphery 22*a* of top wall 22 in the preferred form shown. Seal 40 is annular in shape having an inner diameter corresponding to inner periphery 22*f* of portion 22*d* and an outer diameter corresponding to outer periphery 22*g* of portion 22*e*. Thus, seal 40 is oval in shape and in the most preferred form is dictated by the shapes of its peripheries 22*f* and 22*g* of portions 22*d* and 22*e*. Extension 42 in the most preferred form is not adhered and specifically in the form shown is not adhered to portion 22*d* or any other portions of top wall 22 or bag 18. Additionally, in the preferred form, seal 40 is a cold seal and in the most preferred form is a cohesive formed from natural rubber and isoprene and/or synthetic copolymers components.

Bag 18, according to the preferred teachings of the present invention, can be manufactured in the following manner. Specifically, portion 22*e* is positioned to overlie portion 22*d*. Seal 40 is suitably activated such as by pressure in the preferred form to interconnect portions 22*d* and 22*e* to form wall 22. In the fabrication of bag 18, wall 22 is positioned relative to wall 20 such that second, interconnection portion 26*b* is in the direction of the major axis of the oval shape of wall portion 22*e* and in the most preferred form with extension 42 being radially on the opposite side of wall portion 22*e* than interconnection portion 26*b*. Additionally, it should be appreciated that portion 22*d* can be interconnected to portion 22*e* before, at the same time, or after the interconnection is made between walls 20 and 22 by adhesive strip 26 or portions 26*a* or 26*b* of strip 26.

In the most preferred form, peripheries 20*a* and 22*a* of walls 20 and 22 include peripheral extensions 54 which extend beyond and on diametric opposite sides of the round-like shape of peripheries 20*a* and 22*a* and adhesive strip 26, with one of the pairs of extensions 54 extending radially outward of second, interconnection portion 26*b* and of extension 42 of wall portion 22*e*.

Bag 18 according to the preferred teachings of the present invention can be filled in the following manner. Specifically, after walls 20 and 22 have been interconnected along portion 26*a*, the partially formed bag 18 can be folded along parallel fold lines 32*a* and 32*b* extending from first and second points on opposite sides of and generally coextensive with the ends of portion 26*b*. Fold lines 32*a* and 32*b* are radially spaced generally equal to one half of the diameter of the shape of peripheries 20*a* and 22*a* and in the most preferred form slightly larger than the maximum width in a direction of the minor axis of the oval shape of wall portion 22*e*. In the preferred form, fold lines 32*a* and 32*b* are located on opposite sides of the diameter of the shape of peripheries 20*a* and 22*a* and of the major axis of the oval shape of wall portion 22*e* and equidistant therefrom and in the most preferred form on opposite sides of and outside of wall portion 2*e*. Thus, bag 18 is divided into a central portion 34*a* and first and second wings 34*b* and 34*c* which are folded to overlay central portion 34*a*. Wings 34*b* and 34*c* have a radial width generally equal to one fourth of the diameter of the shape of peripheries 20*a* and 22*a* and generally equal to one half of the radial width of central portion 34*a*. Thus, wings 34*b* and 34*c* do not overlay each other when folded to overlay central portion 34*a*. Bag 18 as folded at this point includes first and second, parallel, straight side edges defined by fold lines 32*a* and 32*b* and upper and lower edges which are generally convex defined by peripheries 20*a* and 22*a* intermediate fold lines 32*a* and 32*b*.

The partially formed bag 18 can then be folded about a third fold line 36 extending generally perpendicularly between the first and second straight side edges defined by fold lines 32*a* and 32*b* and located about one third of the diameter of the shape of peripheries 20*a* and 22*a* from the lower edge. Thus, bag 18 includes a wing 36*a* which includes the lower parts of portion 34*a* and wings 34*b* and 34*c* and which is folded to overlay wings 34*b* and 34*c*, with portion 26*b* being opposite to wing 36*a*. Bag 18 as folded at this point includes first and second, parallel, straight side edges defined by fold lines 32*a* and 32*b*, a straight lower edge defined by fold line 36 extending generally perpendicular to the side edges, and an upper edge which is generally convex defined by peripheries 20*a* and 22*a* intermediate fold lines 32*a* and 32*b* and including portion 26*b*.

While in a folded condition and held with walls 20 and 22 being vertical with the upper edge located vertically above the lower edge, peripheries 20*a* and 22*a* in the upper edge are separated and a food product such as a charge of popcorn kernels, fat or oil, salt, flavorings, or the like are introduced into the interior of bag 18. It should be appreciated that due to the folded condition of bag 18, the charge is generally prevented from passing beyond fold lines 32*a*, 32*b* and 36 and into wings 34*b*, 34*c*, and 36*a* but is retained adjacent center 24 of bag 18.

After the food product has been introduced, portion 26*b* can be suitably activated to interconnect walls 20 and 22 together. Thus, walls 20 and 22 are interconnected together around the entire length of peripheries 20*a* and 22*a*. Additionally, strip 26 and seal 40 close bag 18 so that the food product in the hollow interior of bag 18 is completely sealed from the environment.

After portion 26*b* is sealed, bag 18 can again be folded about a fourth fold line 38 extending generally perpendicularly between the first and second straight side edges defined by fold lines 32*a* and 32*b* and parallel to fold line 36 and located about one third of the diameter of the shape of peripheries 20*a* and 22*a* from the upper edge. Fold line 38 is located adjacent to peripheries 20*a* and 22*a* of wing 36*a* and is located above the food product in the hollow interior of bag 18. Thus, bag 18 includes a wing 38*a* which includes the upper parts of portion 34*a* and wings 34*b* and 34*c* and which is folded to overlay wing 36*a*. It should be appreciated that due to the folded condition of bag 18, the food product is also generally prevented from passing beyond fold line 38 and into wing 38*a* but is retained adjacent center 24 of bag 18. Bag 18 as folded at this point is generally rectangular shaped of a size and shape of conventional folded, paper popcorn bags and includes first and second parallel side edges defined by fold lines 32*a* and 32*b*, and parallel lower and upper edges defined by fold lines 36 and 38, respectively. In the most preferred form, the folded, charged bag 18 is sealed into a flexible overwrap 58 for packaging and storage. Conventionally, such overwrap 58 is formed by clear, opaque, or translucent plastic but could be formed by metalized film, sputtered glass/ceramic or other barrier constructions. It of course should be appreciated that typically such overwrap 58 is removed by the consumer just prior to microwave cooking.

Figure 3:
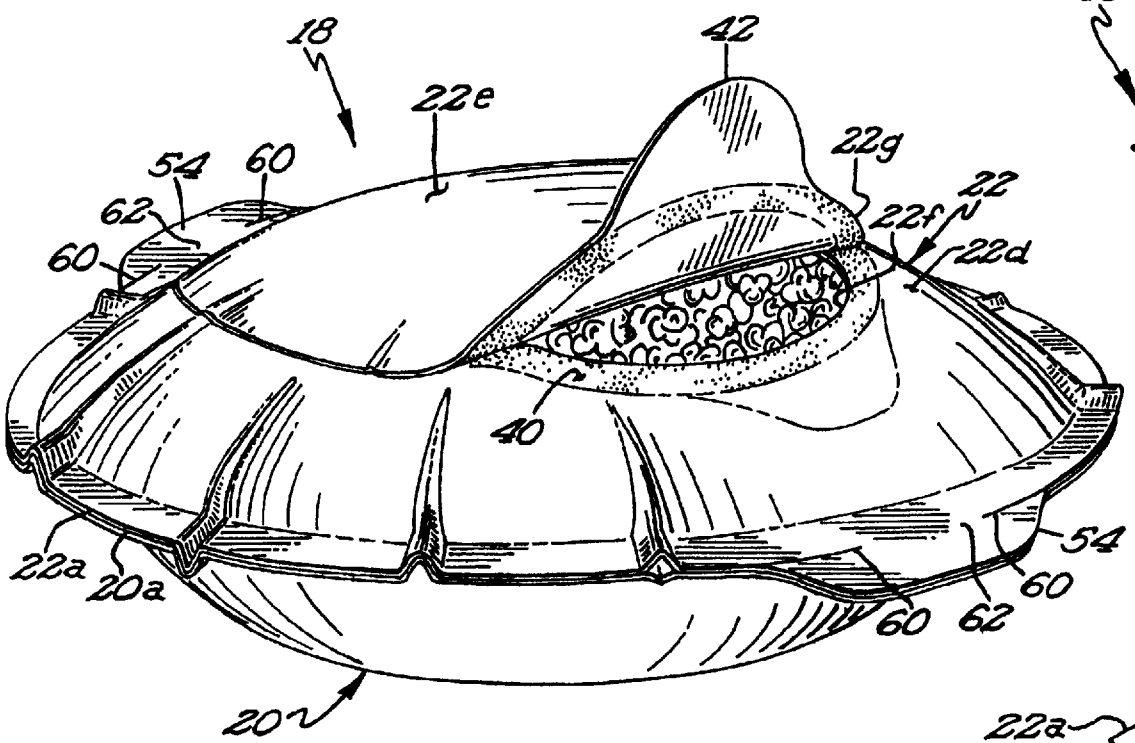
FIG. 3 shows a perspective view of the package of FIG. 1 in an expanded condition showing a preferred method of opening.

For the sake of completeness, it will be assumed that the contents or charge of bag 18 are popcorn kernels, any suitable grain such as rice, maze, barley, sorghum, or the like or other grain, starch or protein based pellets or materials such as half products and pork rinds for being popped, puffed, or expanded when in the microwave oven. Particularly, as with current bags, bag 18 is placed in a microwave oven with bottom wall 20 resting upon the bottom surface of the oven cavity and preferably with bag 18 being partially or completely unfolded by the consumer. When subjected to microwave energy, susceptor patch 30 converts microwave energy into heat, with the heat and remaining microwave energy causing, in the case of popcorn kernels, the popping of the kernels and the generation of water vapor/steam. The water vapor and heated vapor pressure air cause wings 38*a*, 36*a*, 34*b* and 34*c* to unfold or to continue to unfold about fold lines 38, 36, 32*a* and 32*b*, respectively, so that walls 20 and 22 have a continuous shape. Each wall 20 and 22 expand into a bowl, hemispheric or parabolic curve shape from their peripheries 20*a* and 22*a* with the inside surfaces of bottom and top walls 20 and 22 being spaced, expanding bag 18 and increasing the interior volume inside of bag 18 for the popped kernels. It can then be appreciated that due to its flexible nature, bag 18 will expand to an opposing, double dome shape. However, due to the non-extendable nature of the material forming walls 20 and 22, the interconnection between walls 20 and 22 adjacent to peripheries 20*a* and 22*a* will tend to gather and pucker as best seen in FIG. 3 as walls 20 and 22 change their shape from being generally planar to being dome shaped. When bag 18 is formed of paper conventionally utilized for popcorn packages without further processing, the size, shape and direction of such puckers will generally not be uniform around peripheries 20*a* and 22*a* and will tend to vary between different bags 18.

Bag 18 according to the preferred teachings of the present invention is advantageous over prior microwave popcorn bags. Particularly, when first placed in the microwave oven, the pleats of the sides of conventional popcorn packages extend at least partially over the charge of popcorn kernels to be popped. Thus, the initial microwave energy has to penetrate several layers of material which forms the bag. As the material is not completely transparent to microwave energy, part of the microwave energy is absorbed by the material which then is generally not available to the charge of popcorn kernels. However, only a single layer of material forming walls 20 and 22 of bag 18 extends over the charge of popcorn kernels generally from the start of microwave cooking. Thus, it is not necessary for the initial microwave energy to penetrate several layers of material before reaching the charge and therefore the microwave energy is generally available quicker and in greater amounts to the charge.

Further, the bowl or parabolic curve shape of the inflated bag 18 keeps the unpopped kernels huddled closer together even in more than a single layer at the bottom of the shaped wall 20 and in closer contact with susceptor patch 30 in the preferred form. This close nesting or clustering of the unpopped kernels is a very efficient and attractive load for incoming microwaves. Specifically, the cluster load radiates less heat, and temperature increases at a quicker rate. The cluster load has a higher loss tangent (more lossy) than a dispersed load.

Further, as the bowl or parabolic curve shape has a relatively low surface area to volume relationship similar to that of a sphere, walls 20 and 22 include less material which competes for microwave energy with the kernels.

Additionally, when the kernels pop, the popping kernels may spray unpopped kernels from the nesting. However, bag 18 according to the teachings of the present invention allows the unpopped kernels to settle to the bottom of the shaped wall 20 much like a covered Japanese Wok pan does Further, the expansion of bag 18 according to the teachings of the present invention generally does not create folds or crevices which capture unpopped kernels and prevent their movement towards the cluster of any other unpopped kernels and/or susceptor patch 30.

Furthermore, the force of the popping kernels hitting against walls 20 and 22 jostles or vibrates bag 18 which enables the unpopped kernels to fall through the popped kernels and reengage wall 20 and to slide on wall 20 to the bottom thereof. Specifically, the vibration of bag 18 creates agitation of the popped and unpopped kernels in bag 18 resulting in gravimetric separation of the unpopped kernels to the bottom of the popped kernels due to their greater density. In this regard, the bowl or parabolic curve shape of bottom wall 20 enhances the ability of bag 18 to rock in any direction from the force of the popping kernels hitting against walls 20 and 22 to maximize the gravimetric separation of the unpopped kernels to the bottom of the popped kernels.

Still further, the bowl or parabolic curve shape of inflated bag 18 greatly improves popping performance in the diverse microwave ovens available to consumers. As much as a 40% improvement in popping performance was experienced with bag 18 according to the preferred teachings of the present invention compared to paper popcorn bags of conventional shapes under variations experienced in normal use. These variations include but are not limited to microwave ovens of differing wattage, volume, and/or efficiency, fluctuations in electric current, different magnetrons of the same or different manufacture, different wave guides, and the like.

If susceptor patch 30 is provided as in the preferred form, there is no need to include susceptor patch 30 at locations where unpopped kernels are not. Thus, susceptor patch 30 is located only at the bottom of the shaped wall 20 and can be of a minimized size due to the bowl or parabolic curve shape of wall 20. In this regard, and especially due to the bowl or parabolic curve shape of wall 20, susceptor patch 30 may be shaped to minimize material utilized such as being circular in shape or being in non-continuous areas. In the most preferred form, patch 30 is generally located within fold lines 32*a*, 32*b*, 36, and 38.

Also, the round-like shapes of peripheries 20*a* and 22*a* of walls 20 and 22 and thus of bag 18 distribute the popped kernels into a wider distribution field. Being spread in the microwave oven cavity, the popped kernels become less attractive and are fairly transparent to the microwave energy. In addition to the less dense load configuration, the popped kernels are able to dissipate the heat better and therefore not allowing the popped kernels to continue to overcook, carmelize, burn, char, or dry out any further. This results in bag 18 that may be less prone to scorching the popped product.

Further, the round-like shapes of peripheries 20*a* and 22*a* of walls 20 and 22 and thus of bag 18 work very well in all microwave ovens equipped with or without turntables. No matter where the consumer places bag 18 in the microwave oven, bag 18 will always inflate and position itself near the center of the microwave oven. The round-like profile does not allow bag 18 to get hung up in the corners of the microwave ovens where typically cooler spots exist. The round-like shape typically continues to rotate on the turntable ovens. This centered and/or rotating positioning of bag 18 allows bag 18 to move so that it is less likely for any particular point in bag 18 to see specific hot spots or electronic nulls and allows the opportunity for the most consistent and uniform distribution of microwave cooking.

In the most preferred form, seal 40 partially releases during microwave cooking to vent steam from bag 18 during microwave cooking whereas adhesive strip 26 remains secured. After removal from the microwave oven, the consumer can grasp extension 42 between the consumer's thumb and one or more fingers of one hand and pull upwardly and diametrically, with extension 42 being free of adhesive securement resulting in advantages in its ability to be grasped. If necessary, bag 18 can be held by the consumer's other hand such as by grasping peripheral extensions 54 and/or the rim defined by adhesive strip 26 between walls 20 and 22 at the circumferential position corresponding to extension 42. Due to the peelable nature of seal 40, initial movement of extension 42 will release any remaining securement of seal 40 so that the part of portion 22*e* overlying portion 22*d* will separate from portion 22*d* without tearing. In the most preferred form, portion 22*e* is completely removed from the remaining portions of bag 18. After removal of portion 22*e*, portion 22*d* acts like an annular rim in holding the remaining portions of bag 18 in a serving bowl function.

It should be appreciated that although the serving bowl function is accomplished by the multipaper fabrication provided by portions 22*d* and 22*e* in most preferred forms, the serving bowl function can be formed by other manners including by using perforations, tear strips, cut scoring, thinning sealant, and controlled delamination according to the teachings of the present invention. Likewise, although providing the peelable closure in top wall 22 is believed to be advantageous at least because venting occurs at locations spaced from where the consumers hold bag 18 at extensions 54 and because of the serving bowl function, the peelable closure which fails during microwave cooking to provide venting can be formed at other locations such as in portion 26*b*. In particular, after popping the popcorn and while pinching bottom and top walls 20 and 22 between the fingers in the consumer's hands and/or by gripping extension 54, bottom and top walls 20 and 22 can be pulled apart to separate securement of portion 26*b* and to separate portion 26*a* in an amount as desired such as to a circumferential extent allowing the popped popcorn to be poured therefrom or completely removing top wall 22 from bottom wall 20 so that bottom wall 20 performs a serving bowl function.

It should then be appreciated that cold seal 40 between wall portions 22*d* and 22*e* according to the preferred teachings of the present invention is particularly advantageous. Specifically, due to the nonlinear shape of seal 40, several difficulties could arise in maintaining consistent temperatures, pressures, and dwell times across the entire profile required in traditional heat seals. These requirements of traditional heat seals are eliminated by cold seal 40 which results in effectively sealing of wall portion 22*e* to wall portion 22*d* in a consistent manner around the entire peripheries 22*f* and 22*g*. Additionally, although providing a bond at ambient temperatures to prevent leakage during transport, storage, and normal handling, cold seal 40 will soften during microwave cooking. It should be appreciated that during expansion of bag 18, wall portions 22*d* and 22*e* crease and pucker to form the dome shape, with increased stress being placed on the interconnection in the creases and puckers. Due to the elastomeric nature of the natural rubber component of cold seal 40, seal 40 can stretch and give slightly to withstand the crease and pucker stresses to maintain interconnection for the appropriate length of cooking time whereas due to the brittle and crystalline nature of hot seals, hot seals tend to prematurely fail at creases and puckers and specifically while bag 18 has expanded due to vapor pressure and particularly before the completion of the microwave cooking. Further, cold seal 40 has the ability to provide a leak-proof seal before microwave cooking, to provide venting at the appropriate time in the microwave cooking, and to allow removal without tearing after microwave cooking. Particularly, wall portion 22*e* is removed by peeling it back upon itself such that the force applied to seal 40 is in a 180° direction rather than 90° as in current rectangular bags where a separating force is applied to open the bag. The direction of force and the influence it has on the results and modes of failure of seals have long been recognized at least as shown by seal testing methods sanctioned by the TAPPI (Technical Association of Pulp and Paperboard Industry) which specifically controls the direction of force. Seal 40 of the cold type has been discovered to meet the requirements present in a nonlinear seal 40 required in a multiple layer top wall 22 of bag 18 according to the teachings of the present invention.

Furthermore, it should be appreciated that the oval shape of wall portion 22*e* according to the preferred teachings of the present invention is particularly advantageous. Specifically, the area or size of the access opening can be maximized while the width of the access opening can be minimized. Because of its narrow width, portion 22*e* is located exclusively in central portion 34*a*, and fold lines 32*a* and 32*b* do not extend through wall portion 22*e* or seal 40. As fold lines 32*a* and 32*b* are hard or press folds, seal 40 is not subjected to the fold stress which would be encountered if fold lines 32*a* and 32*b* extended therethrough. Although extending through wall portion 22*e* and seal 40, fold lines 36 and 38, which are soft folds, do not detrimentally stress seal 40 as would hard folds. Additionally, due to the oval shape of wall portion 22*e*, the direction of force necessary to break the interconnection of seal 40 is generally along a straight line at a peeling angle that is more tangent to wall portion 22*d* of bag 18 so that there is less propensity for extension 42 and/or wall portion 22*e* to rip or tear. Furthermore, in the most preferred form shown, extension 42 extends radially from wall portion 22*e* in a direction parallel to the machine direction that the fibers within the paper forming wall portion 22*e* extend as the result of its manufacture as diagrammatically shown in the shaded area of FIG. 1, with the machine direction of the fibers being parallel to the major axis of the oval shaped periphery 22*g* of portion 22*e*. As paper will tend to tear in a direction parallel to the fiber direction, arranging extension 42 parallel to the fiber direction results in the pulling force on extension 42 and wall portion 22*e* to be a direction parallel to the fiber direction which tends to result in breaking the interconnection provided by seal 40 before tearing occurs in extension 42 and wall portion 22*e*. Further, wall portion 22*e* including extension 42 can be nested tightly on a web of paper compared to other shapes such as circular so there is less waste of the web of paper and less material is needed for fabrication.

Extensions 42 and 54 provide multiple functions according to the preferred teachings of the present invention. First, extensions 54 extend from the inflated bag 18 in a generally radial fashion, with both extensions 42 and 54 creating a visual indication where bag 18 should be opened as extensions 42 and 54 have the appearance as handle tabs. Second, extensions 42 and 54 provide increased area for grasping and gripping by the consumer. Also, as extensions 54 are located outwardly of adhesive strip 26 and the interior of bag 18, extensions 54 do not have the tendency to be hot to the touch as other portions of bag 18 which have direct contact with the popped popcorn. Thus, extensions 54 provide increased consumer safety from contacting hot surfaces. Similar consumer safety is also provided by extension 42.

Further, it should be appreciated that extensions 54 arranged according to the preferred teachings of the present invention is particularly advantageous. Specifically, with extensions 54 located on peripheries 20*a* and 22*a* and particularly spaced outwardly from where venting occurs from bag 18 around periphery 22*g* of wall portion 22*e*, the hands of the consumer holding extensions 54 are not directly exposed to the vented steam from bag 18. Further, extensions 54 arranged diametrically opposite from each other provide optimal gripping by two hands for holding bag 18 with walls 20 and 22 in a generally horizontal position. In the fabrication of walls 20 and 22, extensions 54 are arranged in the trim out of a square cut in the web of paper, with the square cut being of the smallest size generally equal to the diameter of peripheries 20*a* and 22*a* to minimize waste and maximize material use. In this regard, 3 or 4 extensions 54 could be provided to allow the consumer multiple choices in grasping and removing bag 18 while in the microwave oven and while carrying or otherwise handling bag 18 after its removal from the microwave oven. Additionally, one pair of extensions 54 extending in the same radial direction as extension 42 of wall portion 22*e* and in line with the major axis of the oval shape of portion 22*e* and seal 40 is advantageous during removal of wall portion 22*e* as extension 42 located intermediate periphery 22*f* and the pair of extensions 54 when bag 18 is in an unopened condition can be pulled with one hand of the consumer while the other hand holds the pair of extensions 54 to keep the remaining portions of bag 18 from moving.

The presence of extensions 54 on peripheries 20*a* and 22*a* clearly has an influence on the creases and puckering of walls 20 and 22 during their expansion to the double dome shape and specifically walls 20 and 22 are constrained from creasing and puckering along the width of extensions 54. Particularly, there tends to be a hard crease or pucker at the edge of extensions 54 while adhesive strip 26 at the center of the extensions 54 tends to be weaker and can result in venting of steam therethrough. As the hand of the consumer holds extensions 54, it is desired that extensions 54 be as cool as possible and the consumer's hand grasping extensions 54 not be subjected to heat. Thus, venting of steam at extensions 54 is undesirable as the consumer's hand could come in contact with or in close proximity to the vented steam.

Likewise, providing extensions 54 on both walls 20 and 22 provides added extension strength for holding bag 18 than if bag 18 were held by a simple thickness of paper. Since extensions 54 of walls 20 and 22 are not interconnected, they tend to be cooler and more flexible and less rigid. Thus, extensions 54 are able to flip up or down during expansion of bag 18 and/or in the event they should engage the sides of the microwave oven cavity. Additionally, it is desired to minimize rigidity to minimize crease and puckering constraints. Similarly, if extensions 54 were provided only on wall 20 or 22 and not on both walls 20 and 22, creasing and puckering on wall 20 or 22 including extensions 54 could be constrained while the other wall 20 or 22 not including extensions 54 could not be similarly constrained.

Another manner of reducing the influence of extensions 54 would be to make extensions 54 as circumferentially narrow as possible, but this can be disadvantageous as extensions 54 may be too small to grasp or too fragile if of an elongated length. According to the most preferred teachings of the present invention, extensions 54 are constructed to relieve the constraints to creasing and puckering. As an example, in FIGS. 1 and 3–6, first and second arcuate slits 60 extend along adhesive strip 26 from the opposite sides of the outside edge of extension 54 but leaving a center uncut section 62 such that extensions 54 have a generally T shape. In the most preferred form, section 62 has a circumferential width generally 20% of the total circumferential width of extensions 54 while slits 60 have a circumferential width which is generally double that of section 62 or in other words about 40% of the total circumferential width. As propagation of tearing of the paper can be greater from straight line cuts, in an alternate embodiment shown in FIG. 7, the ends of slits 60 within extensions 54 include scrolls 64 which curve outwardly and back in the opposite direction and then in a direction toward slits 60. Thus, any tendency of the paper to continue to tear under stress from the end of scrolls 64 will simply tear to slits 60 and not result in extensions 54 being separated from walls 20 or 22.

Figure 8:
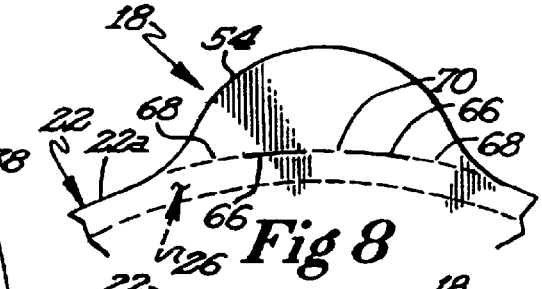
FIGS. 7–10 show partial top plan views of alternate embodiments of extensions for a package fabricated in accordance with the preferred teachings of the present invention.
Figure 9:
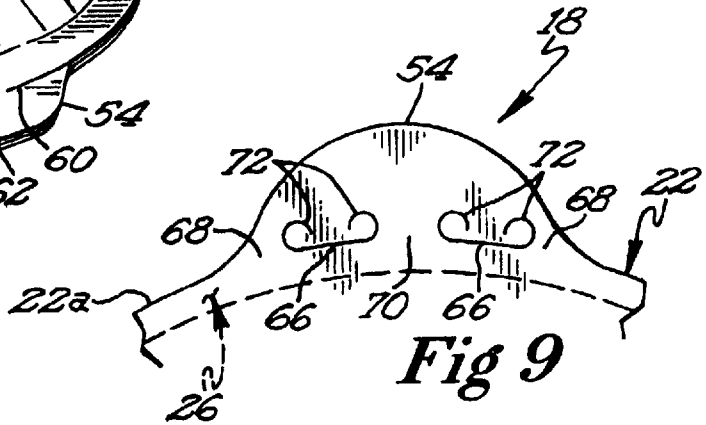

In a further alternate embodiment shown in FIG. 8, a multiplicity of arcuate slits 66 (shown as two in the preferred form) are provided in extensions 54 circumferentially spaced from each other and from the outside edge of extensions 54 and thereby leaving edge uncut sections 68 extending from the outside edge of extensions 54 to the outer ends of the other slits 66 and at least one intermediate uncut section 70 extending intermediate the slits 66. In the preferred form shown, section 70 has a circumferential width generally equal to one-half of the circumferential width of each slit 66 and sections 68 each has a circumferential width generally three and one-half times the circumferential width of each slit 66. Similarly, in an alternate embodiment shown in FIG. 9, the opposite ends of slits 66 include scrolls 72 which curve outwardly and back in the opposite direction and then in a direction toward slits 66. Thus, any tendency of the paper to continue to tear under stress from the ends of scrolls 72 will simply tear to slits 66 and not result in tearing between slits 66 or between slits 66 and the outside edge of extension 54.

Figure 10:
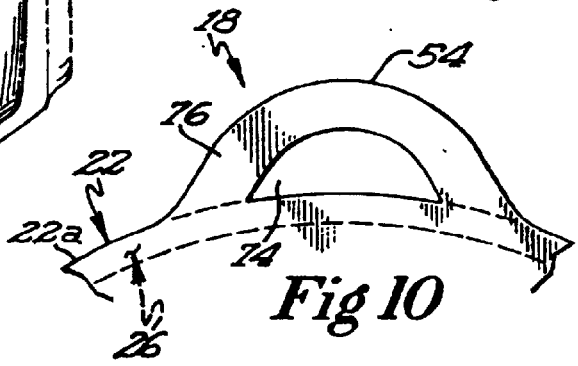

In a further alternate embodiment shown in FIG. 10, an expanded slit or cutout 74 is provided in extensions 54 circumferentially spaced from the outside edge of extensions 54 and thereby leaving a generally U-shaped portion 76 defined between cutout 74 and the outside edge of extensions 54. In the most preferred form, cutouts 74 are centered in extensions 54 and are generally semicircular in shape with the diameter extending along the outer circumference of seal 26 and having a circumferential width generally equal to one third of the circumferential width of extensions 54 at seal 40. Generally, the major advantage of extensions 54 of FIG. 10 is the resulting appearance is much like a conventional handle provided on bowls while the major disadvantage is the increased manufacturing tolerances required in assuring that cutouts 74 are completely cut around its entire boundary.

It should be appreciated that according to the preferred teachings of the present invention including slits 60, 66 and/or 74 expands the design possibilities of extensions 54. As an example, walls 20 and 22 and extensions 54 could be formed by a simple square cut in the web of paper with 4 extensions 54 of a generally triangular shape being provided having their inner edges defined by the outer circumference of seal 40 and the outer edges defined by the outer edges of the square cut. However, it is believed that such an arrangement would give consumers the impression of being unfinished and does not give the impression of handles for grasping bag 18. In any case, one or more extensions 54 can be provided having a variety of shapes which maximize consumer convenience and safety and which meets the desired attributes of the present invention including but not limited to not hanging up in corners of the microwave oven and when constructed to relieve the constraints to creasing and puckering such as in the preferred form by including slits 60, 66 and 74, by including combinations or variations of slits 60, 66 and 74, and by like techniques.

Figure 11:
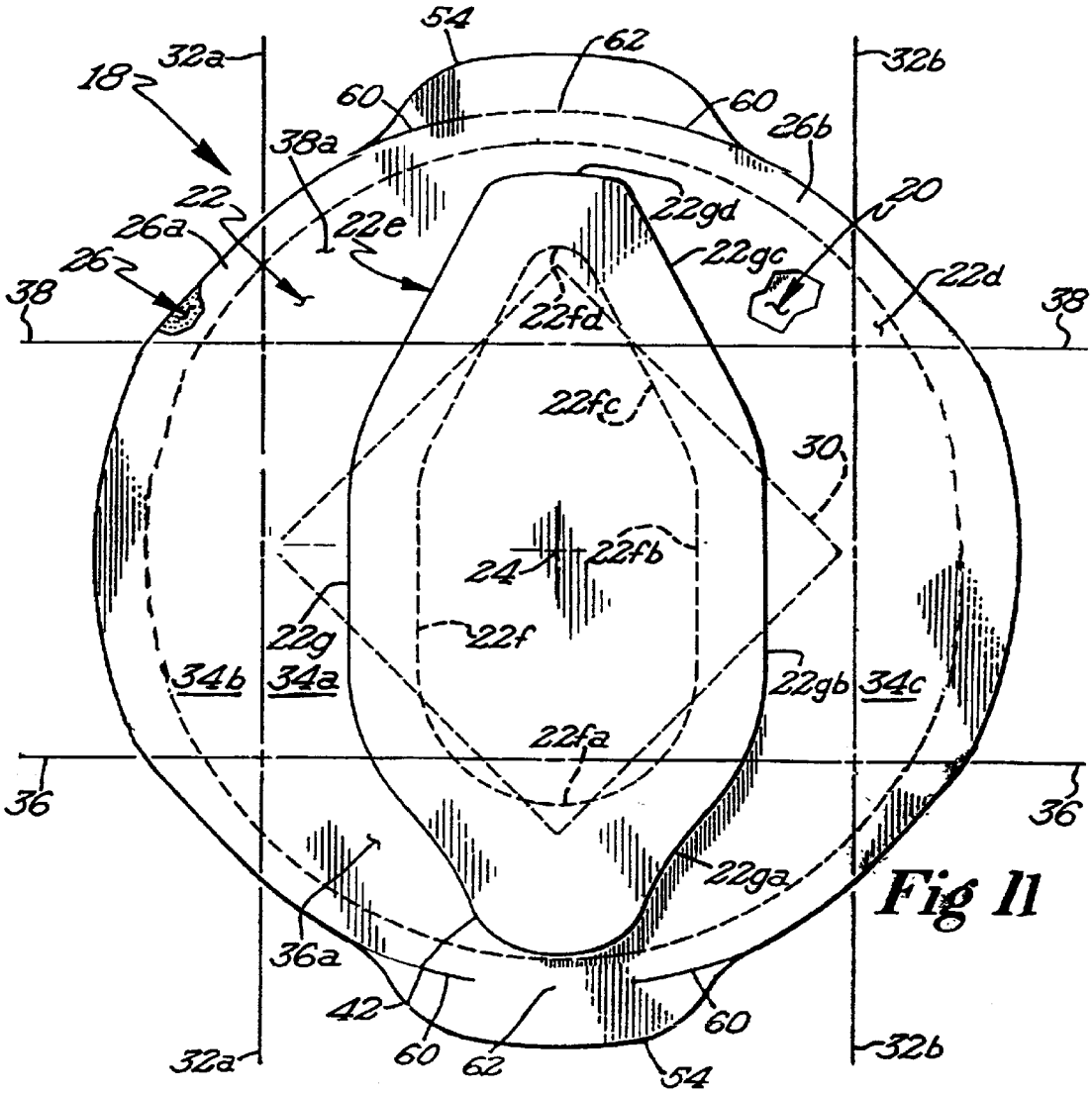
FIG. 11 shows a top plan view of an alternate embodiment of a package fabricated in accordance with the preferred teachings of the present invention in an unfilled, flat condition, with portions broken away.

In a further alternate form shown in FIG. 11, inner periphery 22*f* includes a generally semicircular edge 22*fa* of a diameter generally equal to the minor axis of the generally oval shape. Inner periphery 22*f* further includes first and second linear edges 22*fb* extending parallel to each other and the major axis of the generally oval shape and spaced generally equal to the diameter of edge 22*fa,* with edges 22*fb* extending generally tangentially from the free ends of edge 22*fa*. First and second linear edges 22*f* c extend at an obtuse angle in the order of 130° from the ends of edges 22*fb* towards each other. Inner periphery 22*f* further includes an arcuate edge 22*fd* of a diameter substantially less than the diameter of edge 22*fa,* with edge 22*fd* extending generally greater than 90° but less than 180° with edges 22*fc* extending generally tangentially from the free ends of edge 22*fd.* It can be appreciated that edges 22*fc* and 22*fd* create a portion interconnecting edges 22*fb* to thereby define the generally oval shape. Similarly, outer periphery 22*g* includes edges 22*ga,* 22*gb,* 22*gc* and 22*gd* generally corresponding to, parallel but spaced outwardly from edge 22*fa,* 22*fb,* 22*fc,* and 22*fd,* respectfully. In the most preferred form, extension 42 integrally extends from and is contiguous with edge 22*ga* of periphery 22*g*. Seal 40 in the most preferred form is dictated by the shapes of peripheries 22*f* and 22*g* of portions 22*d* and 22*e*. In particular, seal 40 includes portions generally corresponding to and parallel to but spaced from edges 22*fa* and 22*ga,* 22*fb* and 22*gb,* 22*fc* and 22*gc,* and 22*fd* and 22*gd,* respectfully.

Now that the basic teachings of the present invention have been explained, many extensions and variations will be obvious to one having ordinary skill in the art. For example, although bag 18 of the most preferred form includes the combination of several, unique features believed to obtain synergistic results, packages for use in microwave ovens could be constructed according to the teachings of the present invention including such features singly or in other combinations.

Figure 5:
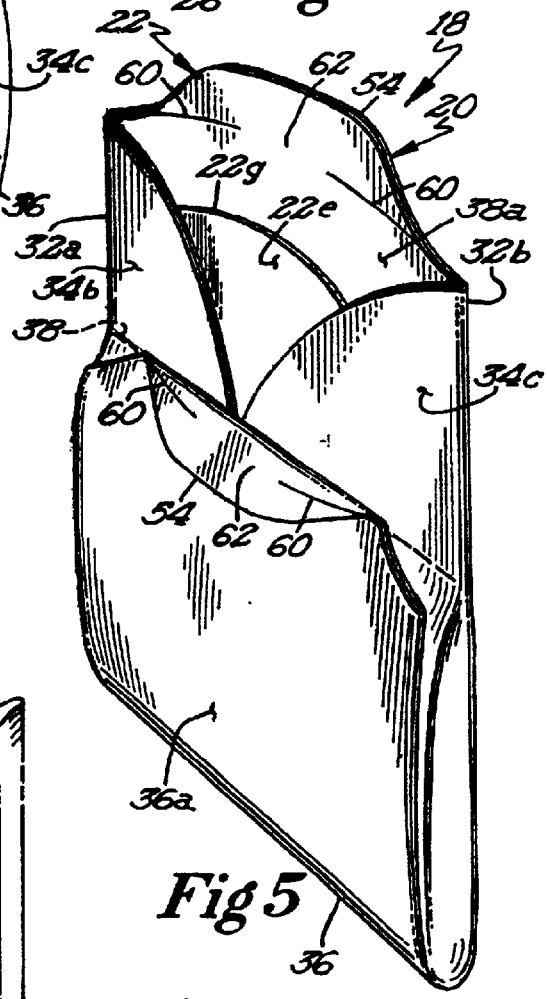
FIG. 5 shows a perspective view of the package of FIG. 1 in a filled, partially folded condition.
Figure 6:
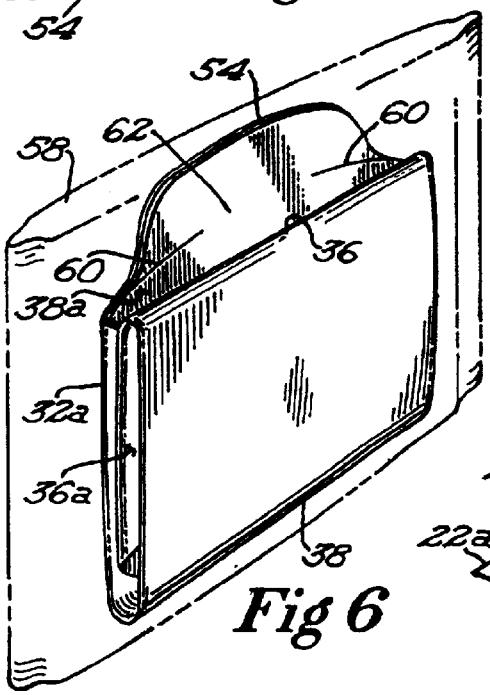
FIG. 6 shows a perspective view of the package of FIG. 1 in a filled, folded or collapsed condition.
Figure 7:
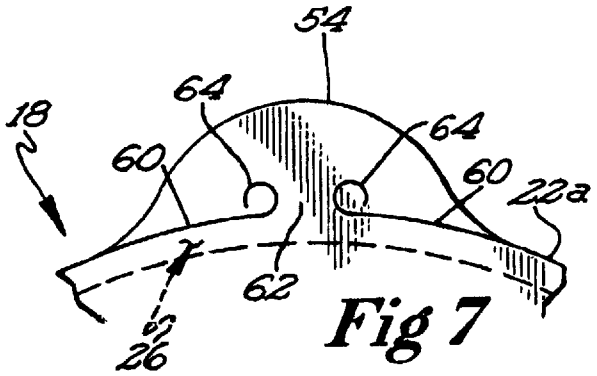

Additionally, although the particular manner of manufacture, filling, and folding of bag 18 is believed to be advantageous including but not limited to having a final conventional, rectangular shape for secondary packaging purposes, bag 18 can be manufactured, filled and/or folded in other manners according to the teachings of the present invention. However, it may be desirable to fold or otherwise configure bag 18 to have a final shape which is different than other conventional shapes to emphasize the uniqueness of bag 18 in the marketing thereof. In this regard, extensions 54, which are exposed in the final shape, could extend linearly from the wing 38*a* as shown in FIG. 6 whereas extensions 54 (and part of adhesive strip 26) can be folded over relative to wing 36*a* as shown in FIG. 5 to reduce the oval size of the final shape.

Likewise, packages for use in microwave ovens can be fabricated and filled in other manners according to the teachings of the present invention. As an example, the ability of seal 40 to be interconnected with the application of pressure in the absence of heat enhances the ability to seal wall portion 22*e* in line with filling bag 18. Thus, adhesive strip 26 could be interconnected around the entire peripheries 20*a* and 22*a* and bag 18 filled through the access opening defined by periphery 22*f* of wall portion 22*d* and wall portion 22*e* positioned over wall portion 22*d* and seal 40 interconnected without the melting, leaking and/or wicking that could occur if seal 40 was of the hot seal type.

Similarly, bag 18 according to the preferred teachings of the present invention could utilize one or more of the opening mechanisms and/or other features as shown and described in U.S. patent application Ser. No. 09/943,637, which is hereby incorporated herein by reference.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Expandable microwave package for holding a food product for popping, puffing or expanding in a microwave oven comprising, in combination: a bag having an interior for holding a charge of food product to be subjected to microwave energy and having a top wall including an access opening, with the bag further including a closure portion having an outer periphery of a size greater than the access opening, with the bag including a seal between the closure portion and the top wall around the access opening, with the bag expanding into an expanded condition, with the seal being generally oval in shape.

2. The expandable microwave package of claim 1 wherein the access opening and the outer periphery of the closure portion are generally oval in shape.

3. The expandable microwave package of claim 2 further comprising, in combination: an extension formed on the outer periphery of the closure portion outward of the seal.

4. The expandable microwave package of claim 3 wherein the oval shape of the outer periphery of the closure portion has a major axis and a minor axis, with the extension extending in line with the major axis.

5. The expandable microwave package of claim 4 wherein the closure portion is formed of paper having fibers having a machine direction parallel to the major axis.

6. The expandable microwave package of claim 4 wherein the top wall includes an outer periphery of a size larger than the access opening; and wherein the extension is of a size located within the outer periphery of the top wall.

7. The expandable microwave package of claim 6 wherein the outer periphery of the top wall has a substantially round shape.

8. The expandable microwave package of claim 5 further comprising, in combination: at least a first handle extending from the bag beyond the outer periphery of the top wall and in line with the major axis, with the extension located intermediate the handle and the access opening.

9. The expandable microwave package of claim 8 further comprising, in combination: a second handle extending from the bag beyond the outer periphery of the top wall diametrically opposite to the first handle.

10. The expandable microwave package of claim 8 wherein the bag has a bottom wall, with the top and bottom walls each having outer peripheries, with the top and bottom walls being directly interconnected together and adjacent to the outer peripheries; and wherein the expandable microwave package further comprises, in combination: a second handle extending from the bag beyond the outer periphery of the bottom wall and in line with the major axis.

11. The expandable microwave package of claim 6 wherein the bag further includes first and second fold lines extending from first and second points on opposite sides of the outer periphery of the top wall, with the first and second fold lines dividing the bag into a central portion and first and second wings, with the outer periphery of the top wall of the first and second wings and the first and second wings overlaying the central portion, with the closure portion located exclusively in the central portion.

12. The expandable microwave package of claim 11 wherein the first and second fold lines are in a spaced parallel relation parallel to the major axis.

13. The expandable microwave package of claim 12 wherein the radial distance between the first and second fold lines is generally equal to a maximum width of the closure portion parallel to the minor axis, with the first and second fold lines located on opposite sides of the major axis and equidistant therefrom.

14. The expandable microwave package of claims 13 wherein the bag further includes a third fold line extending between the first and second fold lines when the first and second wings overlay the central portion, with the third fold line defining a third wing overlaying the first and second wings.

15. The expandable microwave package of claim 14 wherein the third fold line extends generally perpendicular between the first and second fold lines, with the radial distance between the outer periphery of the top wall and the third fold line is generally equal to one third of the diameter of the outer periphery of the top wall.

16. The expandable microwave package of claim 15 wherein the bag includes a fourth fold line extending between the first and second fold lines when the first and second wings overlay the central portion, with the fourth fold line defining a fourth wing overlaying the third wing.

17. The expandable microwave package of claim 16 wherein the fourth fold line extends generally parallel to the third fold line, with the radial distance between the outer periphery of the top wall and the fourth fold line being generally equal to one third of the diameter of the outer periphery of the top wall.

18. The expandable microwave package of claim 16 further comprising, in combination: a susceptor patch extending over the bottom wall and generally between the first, second, third, and fourth fold lines.

19. The expandable microwave package of claim 1 wherein the package holds food products in the form of popcorn kernels.

20. The expandable microwave package of claim 1 wherein the bag has a bottom wall, with the top and bottom walls each having outer peripheries, with the top and bottom walls being directly interconnected together adjacent to the outer peripheries.

21. The expandable microwave package of claim 20 wherein the outer peripheries of the top and bottom walls are of a substantially round shape.

22. The expandable microwave package of claim 21 wherein the top and bottom walls are formed of non-extendable flexible material, with the top and bottom walls expanding into an opposing double dome shape when the food product is popped, puffed or expanded in the microwave oven, with the interconnected outer peripheries puckering as the top and bottom walls expand into the opposing double domed shape.

23. The expandable microwave package of claim 1 wherein the seal includes a peelable closure portion which fails during microwave cooking allowing trapped steam to vent and allowing the bag to be opened to provide access to the popped, puffed or expanded food product through the access opening.

24. The expandable microwave package of claim 23 wherein the seal is a cold seal formed of natural rubber and isoprene and/or synthetic copolymers.

25. The expandable microwave package of claim 1 wherein the bag includes a bottom wall having an outer periphery, with the top wall having an outer periphery; and wherein the bottom and top walls are interconnected together adjacent to the outer peripheries by a first interconnection portion and a second interconnection portion, with the first interconnection portion extending a substantial portion of the outer peripheries, with the first interconnection portion interconnecting the outer peripheries prior to and after the introduction of the food product into the bag, with the second interconnection portion allowing separation of the outer peripheries in the second interconnection portion for the introduction of the food product in the bag and interconnecting the outer peripheries in the second interconnection portion after the introduction of the food product into the bag.

26. The expandable microwave package of claim 1 wherein the top wall includes an outer periphery; and wherein the expandable microwave package further comprises, in combination: at least a first handle extending from the bag beyond the outer periphery of the top wall.

27. The expandable microwave package of claim 26 wherein the oval shape has a major axis and a minor axis, with the handle extending in line with the major axis.

28. The expandable microwave package of claim 26 wherein the seal is a cold seal formed of natural rubber and isoprene and/or synthetic copolymers and which fails during microwave cooking allowing trapped steam to vent and allowing the bag to be opened to provide access to the popped, puffed or expanded food product through the access opening.

29. The expandable microwave package of claim 28 further comprising, in combination: an extension formed on the outer periphery of the closure portion outward of the seal.

30. The expandable microwave package of claim 1, with the seal having a major axis and a minor axis, with the seal including a first, generally semicircular, portion of a diameter generally equal to the minor axis of the generally oval shape, with the seal including second and third portions extending from the first portion and generally parallel to the major axis, with the seal further including a fourth portion extending from and interconnecting the second and third portions.

31. The expandable microwave package of claim 30 wherein the fourth portion includes an arcuate portion.

32. The expandable microwave package of claim 31 with the fourth portion being of equal size and shape as the first, generally semicircular, portion.

33. The expandable microwave package of claim 32 with the second and third portions being arcuate, with the seal being oval in shape.

34. The expandable microwave package of claim 31 wherein the fourth portion includes fifth and sixth portions extending from the second and third portions at an obtuse angle toward each other, with the fifth and sixth portions extending tangentially from the arcuate portion, with the arcuate portion having a diameter substantially less than the diameter of the first portion.

35. The expandable microwave package of claim 30 wherein the fourth portion includes fifth and sixth portions extending from the second and third portions at an obtuse angle toward each other.

* * * * *